US010135228B2

(12) United States Patent
Capka

(10) Patent No.: US 10,135,228 B2
(45) Date of Patent: Nov. 20, 2018

(54) METHOD OF FORMING A METALLIC ELECTRODE ON THE CERAMIC INSULATOR OF A SPARK PLUG

(71) Applicant: Brisk Tábor A.S., Tábor (CZ)

(72) Inventor: Mojmir Capka, Prague (CZ)

(73) Assignee: BRISK TÁBOR, Tábor (CZ)

( * ) Notice: Subject to any disclaimer, the term of this patent is extended or adjusted under 35 U.S.C. 154(b) by 0 days.

(21) Appl. No.: 15/315,670

(22) PCT Filed: Jun. 1, 2015

(86) PCT No.: PCT/CZ2015/000055
§ 371 (c)(1),
(2) Date: Dec. 1, 2016

(87) PCT Pub. No.: WO2016/192689
PCT Pub. Date: Dec. 8, 2016

(65) Prior Publication Data
US 2018/0123325 A1 May 3, 2018

(51) Int. Cl.

| | |
|---|---|
| ***H01T 21/02*** | (2006.01) |
| ***H01T 13/34*** | (2006.01) |
| ***H01T 13/39*** | (2006.01) |
| ***H01T 13/38*** | (2006.01) |
| ***H01J 9/00*** | (2006.01) |
| ***H01T 13/46*** | (2006.01) |

(52) U.S. Cl.
CPC ..... *H01T 21/02* (2013.01); *H01T 13/34* (2013.01); *H01T 13/38* (2013.01); *H01T 13/39* (2013.01); *H01T 13/462* (2013.01)

(58) Field of Classification Search
None
See application file for complete search history.

(56) References Cited

U.S. PATENT DOCUMENTS

| | | | | |
|---|---|---|---|---|
| 8,348,709 | B1 * | 1/2013 | Passman | H01T 21/02 445/7 |
| 2010/0109502 | A1 * | 5/2010 | Nakayama | H01T 13/32 313/141 |
| 2012/0013239 | A1 | 1/2012 | Fujiwara | |

OTHER PUBLICATIONS

International Search Report (PCT/ISA/210) dated Jan. 28, 2016, by the European Patent Office as the International Searching Authority for International Application No. PCT/CZ2015/000055.
Written Opinion (PCT/ISA/237) dated Jan. 28, 2016, by the European Patent Office as the International Searching Authority for International Application No. PCT/CZ2015/000055.

* cited by examiner

*Primary Examiner* — Ashok Patel
(74) *Attorney, Agent, or Firm* — Buchanan Ingersoll & Rooney PC

(57) ABSTRACT

The method of creating a metallic electrode on the ceramic insulator of a spark plug with a deposit of additional material using the laser weld deposition method, where this metallic electrode, formed by a diffusion metallic layer (3) of the joint between the weld deposit of the smelted wire and the insulator (1), is in the shape of a ring in the end part of the insulator body (1) around the central electrode (2) of the spark plug.

17 Claims, 3 Drawing Sheets

METHOD OF FORMING A METALLIC ELECTRODE ON THE CERAMIC INSULATOR OF A SPARK PLUG

This disclosure claims priority under 35 U.S.C. § 371 to International Application No. PCT/CZ2015/000055, filed Jun. 1, 2016, the contents of which are incorporated hereby reference for all purposes.

TECHNICAL FIELD

The subject of the invention is the method of forming a metallic electrode on a ceramic insulator of a spark plug with the deposit of additional material using a laser weld deposition method.

BACKGROUND ART

For the preparation of metallic electrodes on a ceramic insulator, a PVD deposition method (physical vapour deposition) is currently used. The deposition of the electrode material takes place by spraying the target in an inert or reactive atmosphere and subsequent condensing of the forming layer on the insulator's surface. Due to its high sensitivity to deposition parameters, the PVD method has a relatively high scrap rate in industrial conditions. As deposition of layers cannot be localised precisely, the deposited layer is deposited on the entire tip of the insulator. Thus grinding must follow the deposition, during which the conductive layer is removed from undesirable areas, which makes the entire production process even more expensive. Moreover, such deposited layers show limited adhesion to ceramic insulators and thus decreased spark plug service life.

Electrode deposition using a laser combines several advantages. The additional material is applied in the form of a wire to a precisely localised place on the insulator. This operation is final and therefore no further grinding or cleaning operation on the insulator has to follow the weld deposition. Another advantage of this method is the possibility of very quick exchange of the weld deposition material and the insulator shape. The additional material is melted during weld depositing. Upon contact of the molten metal with the ceramics, its capillary action into the porous structure of the ceramics and very good mechanical anchoring of the layer takes place. This significantly improves the adhesion of the deposited layers against the layers prepared using the PVD method, thus also improving the service life of the spark plug. The use of the weld deposit material in the form of a wire leads to the elimination of losses of often very expensive materials (on the basis of Pt, W, Ir, etc.).

The goal of the presented invention is to increase the service life of spark plugs with an electrode deposited on the insulator by creating a diffusion interface between the insulator and the electrode, to decrease the scrap rate of the spark plugs and the time demands and price of the deposition process.

SUMMARY OF THE INVENTION

The subject of this invention is the method of creating a metallic electrode on the ceramic insulator of a spark plug with a deposit of additional material using the laser weld deposition method, where this metallic electrode, formed by a diffusion metallic layer of the joint between the weld deposit of the smelted wire and the insulator, is in the shape of a ring in the end part of the insulator body around the central electrode of the spark plug. The substance of the invention includes first preheating the spark plug insulator by resistance heating to the temperature of 500 to 700° C. at the rate of 100 to 150° C./min to prevent the creation of thermal stresses, and subsequently exposing it to rotation at the speed depending on the required wire weld deposit thickness, where the end part of the insulator, at the distance of 12 to 15 mm from its margin, is preheated to the temperature of the wire weld deposition determined below the temperature of phase transformation of the insulator material by the action of a laser beam swept into a rectangular area homogenously at the power density of laser preheating within the range of 3,500 to 4,000 W/sq. cm. After achieving the weld depositing temperature of the wire, the wire feeding into the area of the created electrode is activated, with the feed speed from 0.5 to 3 mm/360°, and together with the wire feeding activation, the laser output decreases to the power density of 700 to 900 W/sq. cm, while throughout the weld deposition, the end part of the insulator is simultaneously heated at the distance of 12 to 15 mm from its margin and after weld depositing an overlap of 360°+30° of the insulator, the wire feeding is deactivated and the laser output is decreased to zero.

During the laser preheating, the temperature of the ceramic insulator in the area is 100° C. below the temperature of phase transformation of its ceramic material.

The weld deposited wire is advantageously a steel wire with a diameter of 0.6 mm, while the ring-shaped metallic electrode with a height of 0.5 to 5 mm on the ceramic insulator is situated in a preformed groove on the insulator, where the deposit depth of this electrode or its ring thickness is within the range of 0.01 to 1.5 mm.

BRIEF DESCRIPTION OF THE DRAWINGS

In the attached drawings, an example of creating a metallic electrode on the ceramic insulator of a spark plug using the laser weld deposition method with additional material in the form of a wire is depicted.

DETAILED DESCRIPTION OF THE INVENTION

Figures 1A, 1B, 1C:
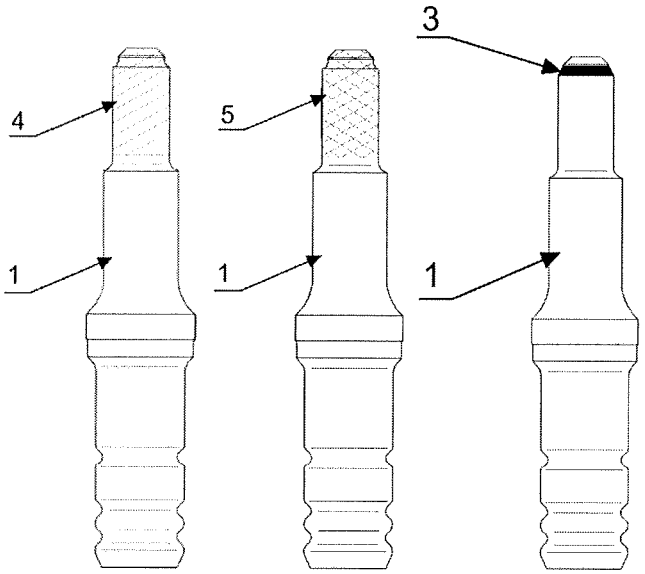
In FIG. 1A, the end part of the spark plug insulator is exposed to resistance preheating.
In FIG. 1B, immediately afterwards, it is exposed to laser preheating, and in FIG. 1C, it is already fitted with the diffusion conductive metallic layer between the ceramic material of the insulator and the additional metallic material of the weld deposited electrode.
Figure 2:
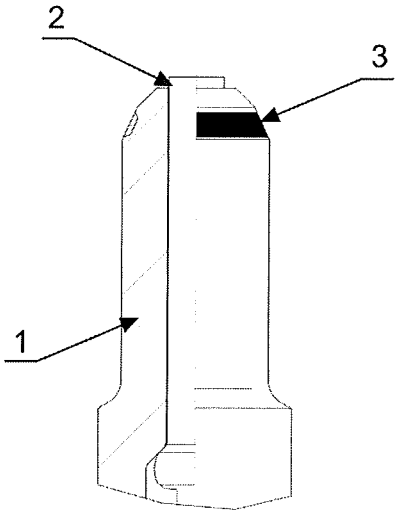
In FIG. 2, in a partial vertical section, a detail of the spark plug end part layout with a metallic electrode created by laser weld deposition on the ceramic insulator is shown.

The principle of the method is intensive heating of the insulator and the additional wire of the Autrod alloy by a laser beam so that only the fed wire of the spark plug insulator ceramics layer with the thickness of 50 to 100 μm is melted. During this process, a diffusion metallic layer 3 between the ceramic material of the insulator 1, formed by 95 to 99% of $Al_2O_3$, and the additional metallic wire of the weld deposited electrode in the form of the Autrod 12.58 steel wire alloyed by Mn—Si (with a copper surface layer) with the diameter of 0.6 mm, made by ESAB, is created.

Meanwhile, the ambient material of the insulator 1 remains unaffected. The welded electrode is in the shape of a ring with a height of 0.5 to 5 mm (depending on the diameter of the wire used) with a deposit depth (ring thickness) from 0.01 to 1.5 mm, situated in a premade groove on the insulator 1 around the central electrode 2 of the spark plug.

A high-performance fibre laser was used, emitting radiation with a wavelength of 1,070 nm, which worked in the continuous mode (CW). The laser beam was led from the laser source via an optic fibre into the scanning head, where it was swept using a system of moving mirrors into a rectangular area with a size of 14×4 mm, with homogenous power distribution. The scanning speed was 100 m/s. This intensive heat source was utilised to preheat the insulator 1 to the weld deposition temperature and for the actual weld deposition process, which is the smelting of the additional wire and creation of the diffusion joint (the deposit of the conductive metallic layer 3 between the weld deposit and the insulator 1).

In order to prevent the creation of thermal stresses in the ceramic insulator 1 due to fast and uneven heating during the additional wire weld deposition, and also in order to increase the speed of the entire process, the insulators 1 are preheated in a continuous resistance furnace to the temperature of 500 to 700° C. at the rate of 100 to 150° C. per minute. After this resistance heating, it is placed into a rotary positioning mechanism, which secures homogenous heating of the tip of the insulator 1 by the laser (the resistance preheating area 4) and rotary motion of the insulator 1 during the wire weld depositing. The rotation speed is chosen as high as possible, depending on the required weld deposit thickness, usually from 50 to 150° per second.

Immediately after the resistance preheating, laser preheating follows. Using the laser and the scanning head, the insulator 1 tip, in the laser preheating area 5 at the distance of 12 to 15 mm from the margin, is homogenously heated from the resistance preheating temperature to the weld deposition temperature, which is determined approximately 100° C. below the value of the phase transformation of the insulator 1 material. The output of the laser during the additional heating of the insulator 1 up to the weld deposition temperature is 2,100 W. The power density during the laser preheating is 3,500 to 4,000 W/sq. cm. After achieving the weld deposition temperature, wire feeding is activated, and the feeding speed is 0.5 to 3 mm/360°. Together with the wire activation, the laser output is decreased to the power density of 700 to 900 W/sq. cm (the laser output during wire weld depositing is 420 W). Throughout the weld depositing, the tip of the insulator 1 is also heated (approximately 12 to 15 mm from the margin), in order to prevent creation of large thermal gradients. After weld depositing an overlap of 360°+30° of the insulator 1, the wire feed is deactivated and the laser output decreases to zero.

It is necessary to discern the temperature of the weld deposition wire and the temperature of the insulator, which differ despite being heated from one source. The wire temperature during weld depositing must always be above its melting point (1,550° C. for steel), while the temperature of the ceramic insulator 1 must be, on the contrary, below the temperature of the phase transformation of the ceramics (approximately by 100° C.).

Figure 3:
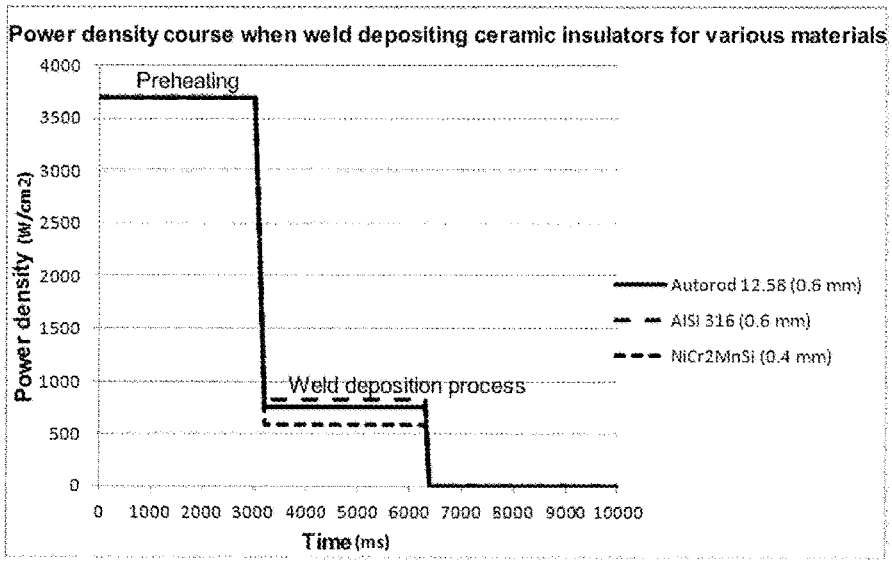
In FIG. 3, the time course of the power density during weld depositing ceramic insulators of a spark plug for various metallic materials is displayed.

In FIG. 3, the time courses of laser output during weld depositing of ceramic insulators 1 are shown for various materials of the welding wire, for example for welding wires of the Autrod 12.58 steel with a wire diameter of 0.6 mm (steel alloyed by Mn—Si with a copper surface layer), and AlSi 316 with a wire diameter of 0.6 mm, and NiCr2MnSi with a diameter of 0.4 mm.

Figure 4:
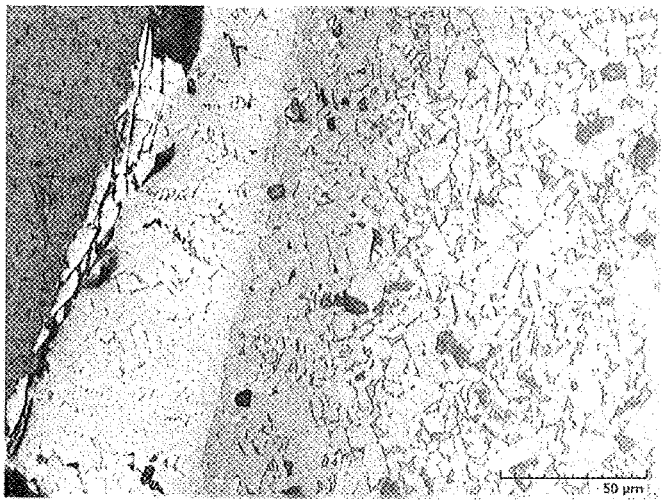
In FIGS. 4 and 5, there are photographs of a cut of a metallic electrode weld deposited on an insulator with a diffusion layer between the electrode and the insulator.
Figure 5:
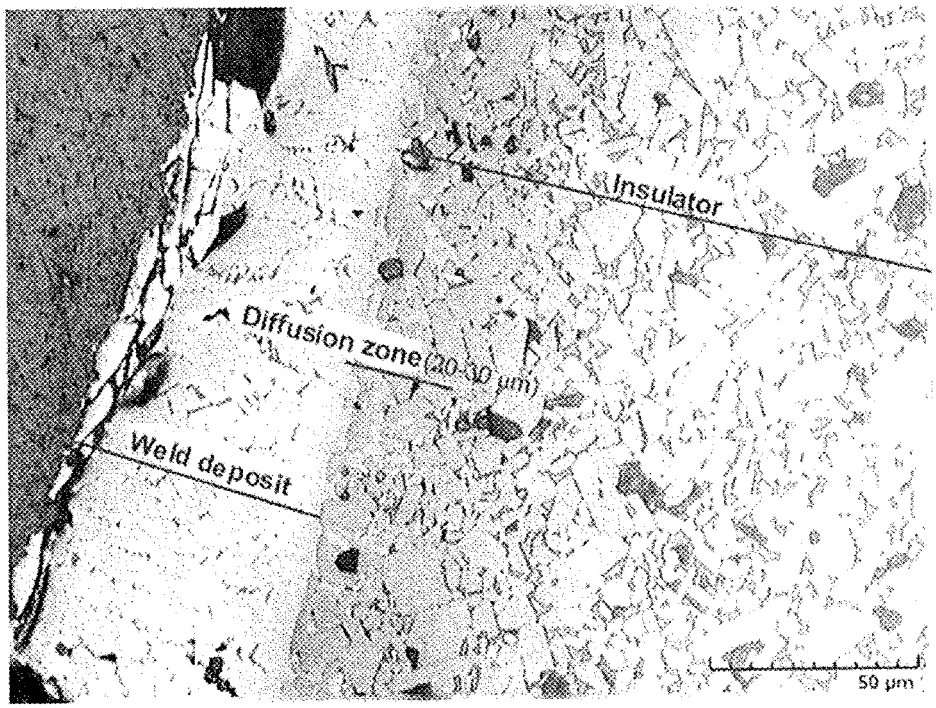

Furthermore, two photographs (FIGS. 4 and 5) of the cut through the metallic layer 3 on the insulator 1 with the intermediate diffusion layer are attached.

The invention claimed is:

1. The method of creating a metallic electrode on the ceramic insulator of a spark plug with a deposit of additional material using the laser weld deposition method, where this metallic electrode, formed by a diffusion metallic layer (3) of the joint between the weld deposit of the smelted wire and the insulator (1), is in the shape of a ring in the end part of the insulator body (1) around the central electrode (2) of the spark plug, characterized in that first, the spark plug insulator (1) is preheated by resistance heating to the temperature of 500 to 700° C. at the rate of 100 to 150° C./min to prevent the creation of thermal stresses, and subsequently it is exposed to rotation at the speed depending on the required wire weld deposit thickness, where the end part of the insulator (1), at the distance of 12 to 15 mm from its margin, is preheated to the temperature of the wire weld deposition determined below the temperature of phase transformation of the insulator (1) material by the action of a laser beam swept into a rectangular area homogenously at the power density of laser preheating within the range of 3,500 to 4,000 W/sq. cm, after achieving the weld depositing temperature of the wire, the wire feeding into the area of the created electrode is activated, with a feed speed from 0.5 to 3 mm/360°, and together with the wire feeding activation, the laser output decreases to the power density of 700 to 900 W/sq. cm, while throughout the weld deposition, the end part of the insulator is simultaneously heated at a distance of 12 to 15 mm from its margin and after weld depositing an overlap of 360°+30° of the insulator (1), the wire feeding is deactivated and the laser output is decreased to zero.

2. The method according to claim 1, characterized in that during laser preheating the temperature of the ceramic insulator (1) in the area is 100° C. below the temperature of the phase transformation of the ceramic material.

3. The method according to claim 1, characterized in that that the weld deposited wire is a steel wire with the diameter of 0.6 mm, while the ring-shaped metallic electrode with the height of 0.5 to 5 mm on the ceramic insulator (1) is situated in a preformed groove on the insulator (1), where the deposit depth of this electrode or the ring thickness of this electrode is within the range of 0.01 to 1.5 mm.

4. A method of creating a metallic electrode on a ceramic insulator of a spark plug, comprising:

preheating the ceramic insulator;

projecting a laser output of a laser onto an end part of the ceramic insulator;

rotating the ceramic insulator to rotation at a speed dependent on a required wire weld deposit thickness, wherein the rotating the ceramic insulator includes preheating an end part of the ceramic insulator to a first threshold temperature by the projected laser output;

feeding a wire into an area for creating the metallic electrode;

decreasing laser output to a threshold power density to prepare for welding the wire to the ceramic insulator;

further heating the end part of the ceramic insulator to a second threshold temperature to prepare for welding the wire to the ceramic insulator; and welding the wire to the ceramic insulator.

5. The method according to claim 4, wherein the metallic electrode is substantially in a shape of a ring on the end part of the ceramic insulator.

6. The method according to claim 5, wherein the metallic electrode is formed substantially around a central electrode of the spark plug.

7. The method according to claim 4, wherein preheating the ceramic insulator includes resistance heating to a temperature of approximately 500° C. to approximately 700° C. at a rate of approximately 100° C./min to approximately 150° C./min to prevent a creation of thermal stresses.

8. The method according to claim 7, wherein preheating the ceramic insulator further includes the temperature being approximately 100° C. below a temperature of a phase transformation of the ceramic material.

9. The method according to claim 4, wherein the end part of the ceramic insulator is at a distance of approximately 12 mm to approximately 15 mm from a margin of the ceramic insulator.

10. The method according to claim 4, wherein the first threshold temperature includes a temperature of the wire weld deposit determined below a temperature of phase transformation of the ceramic insulator by an action, in response to achieving the wire weld deposit temperature, of a laser beam swept into a rectangular area homogenously at a power density of laser preheating within a range of approximately 3,500 W/sq. cm to approximately 4,000 W/sq. cm.

11. The method according to claim 4, wherein the feeding the wire includes feeding the wire at a feed speed from approximately 0.5 mm/360° to approximately 3 mm/360°.

12. The method according to claim 4, wherein the threshold power density includes a power density of approximately 700 W/sq. cm to approximately 900 W/sq. cm.

13. The method according to claim 4, wherein the welding the wire to the ceramic insulator includes weld depositing an overlap of 360°+30° of the ceramic insulator.

14. The method according to claim 4, further comprising deactivating feeding the wire and decreasing the laser output to a power density of approximately zero.

15. The method according to claim 4, wherein the wire is a steel wire with a diameter of approximately 0.6 mm.

16. The method according to claim 4, wherein the metallic electrode includes a height of approximately 0.5 mm to approximately 5 mm on the ceramic insulator and is configured to be disposed in a preformed groove on the ceramic insulator.

17. The method according to claim 16, wherein the metallic electrode includes a deposit depth within a range of approximately 0.01 mm to approximately 1.5 mm.

* * * * *